US006616711B1

(12) United States Patent
Känzig et al.

(10) Patent No.: US 6,616,711 B1
(45) Date of Patent: Sep. 9, 2003

(54) RESIST PRINTING ON HYDROPHOBIC FIBER MATERIALS

(75) Inventors: Alex Känzig, Therwil (CH); Claudius Brinkmann, Lörrach (DE)

(73) Assignee: Ciba Speciality Chemicals Corporation, Tarrytown, NY (US)

( * ) Notice: Subject to any disclaimer, the term of this patent is extended or adjusted under 35 U.S.C. 154(b) by 0 days.

(21) Appl. No.: 09/719,804

(22) PCT Filed: Jun. 10, 1999

(86) PCT No.: PCT/EP99/04009

§ 371 (c)(1),
(2), (4) Date: Dec. 15, 2000

(87) PCT Pub. No.: WO99/67459

PCT Pub. Date: Dec. 29, 1999

(30) Foreign Application Priority Data

Jun. 19, 1998 (EP) ..... 98810565

(51) Int. Cl.[7] ..... D06P 3/54

(52) U.S. Cl. ..... 8/456; 8/478; 8/485; 8/922; 8/576; 8/606

(58) Field of Search ..... 8/456, 498, 922, 8/485, 576, 602; 510/423

(56) References Cited

U.S. PATENT DOCUMENTS 4,276,205 A * 6/1981 Ferry
4,406,661 A * 9/1983 Buhler et al.
4,421,516 A 12/1983 Stahl et al. ..... 8/464
4,428,750 A 1/1984 Birke et al. ..... 8/461
4,631,067 A * 12/1986 Hussamy
5,634,949 A * 6/1997 Hohmann et al.
5,917,120 A 6/1999 Rommel et al. ..... 8/445

FOREIGN PATENT DOCUMENTS

EP 0021055 1/1981
EP 0088996 9/1983
EP 0831168 3/1998

OTHER PUBLICATIONS

Derwent Abstr. 80–17584C for JP 55012851 (1980).
D. Brierley et al., Discharge and Resist Printing of Polyester, International Textile Reports, vol. 65, No. 9, (1984), pp. 611–617, abstract only.

* cited by examiner

*Primary Examiner*—Margaret Einsmann
(74) *Attorney, Agent, or Firm*—Kevin T. Mansfield

(57) ABSTRACT

This invention relates to a process for printing hydrophobic fiber materials with disperse dyes, which comprises 1) dyeing or printing the fiber materials overall with a disperse dye, and 2) printing the fiber materials in areas with a printing paste, which comprises as component (A), at least one cationic assistant, as component (B), at least one polyethylene glycol, as component (C), at least one noniono-genic detergent and, optionally, as component (D), at least one disperse dye, it being possible for steps 1) and 2) to be carried out in any sequence and for step 2) to be carried out repeatedly without using any dye, or using different dyes, and, if necessary, drying the fiber material thus treated and then fixing the dye on the fiber material by heat treatment. The novel process affords multicolored prints having sharp contours and very good fastness to hot light.

11 Claims, No Drawings

RESIST PRINTING ON HYDROPHOBIC FIBER MATERIALS

The present invention relates to a special process for printing hydrophobic fibre materials with disperse dyes by the resist printing process.

The resist printing process with disperse dyes is known for hydrophobic fibre materials. However, these materials, especially polyester fibre materials, are usually printed by the so-called discharge resist process in which the predyed or preprinted base dye is destroyed locally by treatment with a strongly alkaline assistant and by printing these areas with one or several other dyes which must by discharge resistant. Treatment with the discharge agent is, however, ecologically and economically disadvantageous; thus, for example, the treated fibre material may be attacked and damaged by the action of strong alkali. There is therefore a need for a simpler resist printing process, which is gentle on the fibre, for printing hydrophobic fibre materials, especially polyester fibre materials.

Surprisingly, it has now been found that the hydrophobic fibre material can be printed in a manner which is gentle on the fibre by the process of this invention, the resulting print having good allround fastness properties and, in particular, very good fastness to hot light.

Accordingly, this application relates to a process for printing hydrophobic fibre materials with disperse dyes, which process comprises 1) dyeing or printing the fibre materials overall with a disperse dye, and
2) printing the fibre materials in areas with a printing paste, which comprises
   as component (A), at least one cationic assistant,
   as component (B), at least one polyethylene glycol,
   as component (C), at least one nonionogenic detergent and, optionally,
   as component (D), at least one disperse dye, it being possible for steps 1) and 2) to be carried out in any sequence and for step 2) to be carried out repeatedly without using any dye, or using different dyes, and, if necessary, drying the fibre material thus treated and then fixing the dye on the fibre material by heat treatment.

Disperse dyes suitable for steps 1) and 2) of the novel process are, for example, those dyes which are described in Colour Index, 3rd edition (3rd Revision 1987 including additions and amendments up to No. 85) under "Disperse Dyes". These dyes include, for example, car-boxylic acid- and/or sulfonic acid group-free nitro, amino, aminoketone, ketoninime, methine, polymethine, diphenylamine, quinoline, benzimidazole, xanthene, oxazine or coumarine dyes and, in particular, anthraquinone and azo dyes, such as mono- or disazo dyes.

Dyes which are preferably used for the novel process are those of formulae (1)

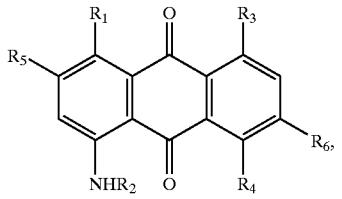

wherein $R_1$ is hydroxy or amino, $R_2$ is hydrogen; phenyl which is unsubstituted or substituted by $C_1$–$C_4$ alkyl, $C_1$–$C_4$ alkoxy, hydroxy-$C_1$–$C_4$ alkyl or $C_1$–$C_4$ sulfo, $R_3$ is hydrogen, hydroxy, amino or nitro, $R_4$ is hydrogen, hydroxy, amino or nitro, $R_5$ is hydrogen, halogen or $C_1$–$C_4$ alkoxy, and $R_6$ is hydrogen, halogen or —O—$(CH_2)_2$—O—$COOR_7$, wherein $R_7$ is $C_1$–$C_4$ alkyl or phenyl, (2)

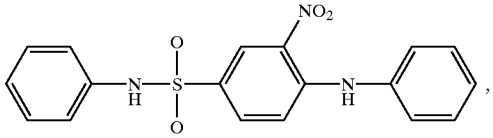

(3)

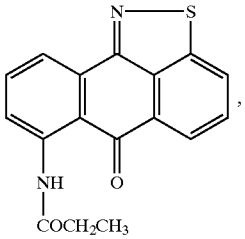

(4)

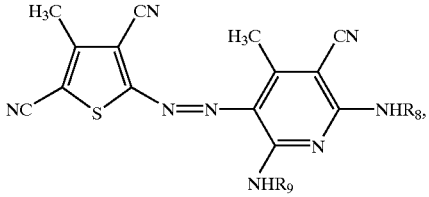

wherein $R_8$ and $R_9$ are each independently of the other hydrogen, —$(CH_2)_2$—O—$(CH_2)_2$—OX or —$(CH_2)_3$—O—$(CH_2)_4$—OX, wherein X is hydrogen or —$COCH_3$, (5)

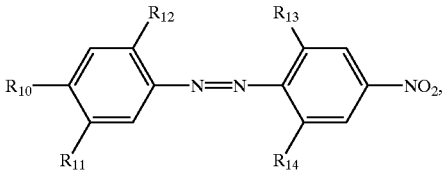

wherein

Rio is amino which is mono- or disubstituted by —$(CH_2)_2$—O—$COCH_3$, —$(CH_2)_2$—CN, —CH$(CH_3)$—$COOCH_3$ or —$CH_2$—C(OH)$CH_3$, $R_{11}$ is hydrogen, $C_1$–$C_4$ alkyl or halogen, $R_{12}$ is hydrogen or $NHCOR_{15}$, wherein $R_{15}$ is $C_1$–$C_3$alkyl, $R_{13}$ is hydrogen or halogen, and $R_{14}$ is halogen, nitro or cyano, (6)

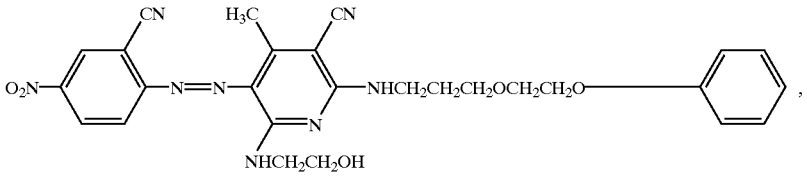

(7)

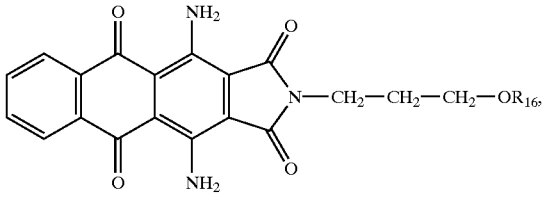

wherein $R_{16}$ is methyl, ethyl or —$(CH_2)_2$—O—$C_1$–$C_2$ alkyl, and (8)

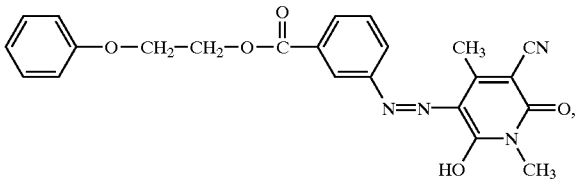

The amounts in which the disperse dyes are used in the dye baths or printing pastes can vary, depending on the desired tinctorial strength; advantageous amounts having been found to be usually from 0.01 to 15% by weight, preferably from 0.1 to 10% by weight, based on the total sum of the dyes per 1 litre of the liquor, or from 0.01 to 400 g, preferably from 0.2 to 300 g, more preferably from 0.5 to 200 g, of the dyes per kg of printing paste.

If the hydrophobic fibre material is dyed in step 1), a continuous dyeing process is usually used, for example the padding process. If appropriate, the dyed material is dried before further treatment, for example for 1 to 5 minutes at 80 to 1 40° C.

In addition to the dye, the dye liquor can contain other customary additives, for example acid donors, such as aliphatic amine chlorides or magnesium chloride, the aqueous solutions of inorganic salts, such as of alkali chlorides or alkali sulfates, alkali hydroxides, urea, thickeners, such as alginate thickeners, water-soluble cellulose alkyl ether, and also levelling agents, antifoams and/or deaerators, penetration accelerators, migration inhibitors, UV ab-sorters and wetting agents.

The printing paste which may optionally be used in step 1) is a printing paste customarily used in printing technology, which comprises, in addition to the dye, the conventional assistants, for example thickeners of natural or synthetic origin, for example commercially available alginate thickeners, starch ethers or carob seed grain ether, in particular sodium alginate, by themselves or in admixture with modified cellulose, preferably with 20 to 25% by weight of carboxymethylcellulose.

In the above printing paste, it is preferred to use synthetic thickeners, for example those based on poly(meth)acrylic acids, poly(meth)acrylamides, and their co- or terpolymers. If desired, the printing paste can also contain acid donors, such as butyrolactone or sodium hydrogenphosphate, preservatives, sequestrants, emulsifiers, water-insoluble solvents, oxidants, UV absorbers or deaerators.

The material printed in step 1) may optionally be dried before further treatment, for example for 1 to 5 minutes at 80 to 140° C.

Suitable components (A) in the printing paste used in step 2) are in particular organic poly-mer compounds containing quaternised amines; salts of nitrogen-containing organic polymer compounds, or aminoxides of formula (9)

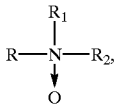

wherein

R is an aliphatic radical containing 8 to 24 carbon atoms, and $R_1$ and $R_2$ are each independently of the other an aliphatic radical which is unsubstituted or substituted by hydroxy, $C_1$–$C_4$ alkoxy, halogen, sulfo or acyl containing 1 to 24 carbon atoms, or a radical —$(CH_2CH_2O)_kW$, wherein k is a number from 2 to 80, and W is $C_1$–$C_4$alkyl, acyl, phenyl, naphthyl, benzyl or, preferably, hydrogen.

R defined as aliphatic radical containing 8 to 24 carbon atoms is, for example, octyl, nonyl, decyl, dodecyl, tetradecyl, hexadecyl, heptadecyl, octadecyl, eicosyl or docosyl. $R_1$ and $R_2$ defined as aliphatic radical containing 1 to 24 carbon atoms is, for example, a $C_1$–$C_{24}$ alkyl radical, such as methyl, ethyl, n-propyl, isopropyl, n-butyl, sec-butyl, tert-butyl, isobutyl, pentyl, hexyl, heptyl, octyl, nonyl, decyl, dodecyl, tetradecyl, hexadecyl, heptadecyl, octadecyl, eicosyl or docosyl.

Of these compounds, the organic polymer compounds based on the polymono- and polydi-allylamines merit particular mention, for example polydiallyl ammonium hydrochloride or polydiallyldimethyl ammonium chloride, and also ethoxylated and/or propoxylated fatty amines which are quaternised, for example, with methyl chloride, dimethyl sulfate or benzyl chloride, such as dodecylamine which is reacted with 17 ethylene oxide units and quater-nised with methyl chloride.

The printing paste contains 1 to 70, preferably 1 to 40, more preferably 1 to 30 g of the catio-nic assistant per 1 kg of the printing paste.

A suitable component (B) for use in the printing paste used in step 2) is advantageously a polyethylene glycol having a molecular weight in the range from 200 to 9000, preferably from 200 to 2500.

The printing paste usually comprises 5 to 140, preferably 5 to 60 g, of a polyethylene glycol per 1 kg of printing paste.

Component (C) in the printing paste used in step 2) is, for example, fatty acid polyglycol esters which are optionally end-capped, fatty acid esters of polyvalent alcohols, for example diethylene glycol or glycerol, naturally occurring and optionally partially saponified neutral fats or, preferably, those compounds which are obtained by adding 4 to 80 ethylene oxide units and/or propylene oxide units to fatty alcohols, fatty amines, fatty acids or alkylaryls, such as nonyl- or octylphenol.

Examples of these compounds to be mentioned are cetyl alcohol containing 4–6 ethylene oxide units, cetyl alcohol containing 10–14 ethylene oxide units, tallow fatty alcohol containing 10 to 30 ethylene oxide units, lauryl alcohol containing 5–8 ethylene oxide units, nonyl-phenol containing 3 to 15 ethylene oxide units, castor oil containing 30–50 ethylene oxide units or oleic acid containing 5 to 20 ethylene oxide units.

It is advantageous to use nonionogenic detergents in the printing paste used according to this invention, which detergents do not foam or foam only little.

The printing paste usually contains 1 to 70, preferably 5 to 40 g, of the nonionogenic detergent per 1 kg of printing paste.

The printing paste used in step 2) advantageously contains as additional component a poly-propylene glycol having a molecular weight in the range from 100 to 2000, preferably from 200 to 600, or a dipropylene glycol.

In addition to the components mentioned above, the printing paste used in step 2) can also contain other conventional assistants, for example usefully thickeners of natural or synthetic origin, such as commercially available alginate thickeners, starch ethers or carob seed grain ether, in particular sodium alginate, by themselves or in admixture with modified cellulose, in particular containing preferably 20 to 25% by weight of carboxymethylcellulose. It is also possible to use synthetic thickeners in the printing paste of this invention, for example those based on poly(meth)acrylic acids, poly(meth)acrylamides, and their co- or terpolymers.

The printing paste used in step 2) can also contain alkylene oxide condensates (block polymers), such as ethylene oxide adducts with polypropylene oxide (so-called EO-PO block polymers) and propylene oxide adducts with polyethylene oxide (so-called reverse EO-PO block polymers). It is particularly preferred to use ethylene oxide/propylene oxide block polymers, the polypropylene oxide base of which has a molecular weight in the range from 1000 to 8000, preferably from 1000 to 5000, more preferably from 2000 to 4000, and an ethylene oxide contained in the entire molecule of 10 to 90%, preferably of 20 to 80%.

If desired, the printing paste used in step 2) can also contain acid donors, such as butyrolac-tone or sodium hydrogenphosphate, preservatives, sequestrants, emulsifiers, water-inso-luble solvents, oxidants, UV absorbers or deaerators.

Suitable preservatives are, in particular, formaldehyde-donating agents, such as paraformal-dehyde and trioxane, especially aqueous, about 30 to 40% by weight formaldehyde solutions; as UV absorbers in particular triazine UV absorbers; as sequestrants e.g. nitrilotriace-tic sodium, ethylenediaminetetracetic sodium, preferably sodium polymetaphosphate, more preferably sodium hexametaphosphate; as emulsifiers preferably adducts of an alkylene oxide and a fatty alcohol, preferably an adduct of oleyl alcohol and ethylene oxide; as water-insoluble solvent high-boiling saturated hydrocarbons, especially paraffins having a boiling range from about 160 to 210° C. (so-called white spirits); as oxidants e.g. an aromatic nitro compound, preferably an aromatic mono- or dinitrocarboxylic acid or -sulfonic acid which may be in the form of an alkylene oxide adduct, in particular a nitrobenzenesulfonic acid, and as deaerator e.g. high-boiling solvents, preferably turpentine oils, higher alcohols, preferably $C_8$–to $C_{10}$ alcohols or terpene alcohols.

The novel process can be used for different hydrophobic fibre materials.

Polyester fibre materials are preferred. Suitable polyester fibre materials are those which consist entirely or partly of polyester. Examples thereof are cellulose ester fibres, for example cellulose-2½-acetate fibres and -triacetate fibres and, in particular, linear polyester fibres which may also be acid-modified and which are obtained, for example, by condensing tere-phthalic acid with ethylene glycol, or isophthalic acid or terephthalic acid with 1,4–bis(hydroxymethyl)cyclohexane, and also fibres of mixed polymers of terephthalic and isophthalic acid with ethylene glycol. Also suitable are polyester-containing fibre blends, i.e. mixtures of poly-ester and other fibres, in particular cotton/polyester fibre materials. Wovens, knits or webs of these fibres are mainly used.

For printing the hydrophobic fibre materials, the printing paste is applied overall or in areas directly onto the fibre material, conveniently using printing machines of conventional make, for example rotogravure, rotary screen printing and flat screen printing apparatus.

The novel process is preferably carried out in a "one step process" on the "H. W. Dyeing & Discharge Printing Line" apparatus, of Johannes Zimmer, A-9020 Klagenfurt (WO 96/28604).

If required, the fibre material is dried after steps 1) and 2) have been carried out, for example at temperatures of up to 150° C., preferably in the range from 80° to 140° C. Drying can also be carried out by IR irradiation.

The subsequent fixing of the fibre material is usually carried out by thermofixation or super-heated steam under atmospheric pressure (HT fixing). Fixing is carried out in this case under the following conditions:

HT fixing: 1 to 50 minutes at 100 to 240° C., preferably 1 to 12 minutes at 160 to 200° C., thermofixing: 1 to 50 minutes at 100 to 240° C., preferably 1 to 10 minutes at 160 to 220° C.

The fibre material dyed and/or printed according to this invention is normally washed off after fixing and is then finished in conventional manner by cleaning in alkaline medium under reductive conditions, e.g. using sodium dithionite. After cleaning, the fibre material is rinsed again and dried.

The prints obtainable by the novel process on polyester fibre materials have good allround fastness properties; they have, for example high fibre-dye bond stability both in the acid and in the alkaline range, good fastness to wet treatment, such as fastness to washing, water, seawater and perspiration, good fastness to chlorine, fastness to rubbing, ironing and pleating and are particularly distinguished by an extension of the brilliant shades with high fastness to light and hot light.

This invention also relates to a printing paste formulation, which comprises, as component (A), 1 to 50% by weight of a cationic assistant, as component (B), 1 to 50% by weight of a polyethylene glycol, and as component (C), 1 to 50% by weight of a nonionogenic detergent.

The novel formulation is distinguished by excellent storage stability. There is no phase separation even after storing for 2 months at temperatures from −10 to +40° C.

Components (A), (B) and (C) have the above meanings and preferred meanings.

A preferred printing paste formulation is that which comprises, as component (A), 2 to 20% by weight of a cationic assistant, as component (B), 5 to 50% by weight of a polyethylene glycol, and as component (C), 3 to 30% by weight of a nonionogenic detergent.

Besides the components (A), (B) and (C), the novel printing paste formulation can contain as additional component a polypropylene glycol having a molecular weight from 100 to 2000, preferably from 200 to 600, or a dipropylene glycol and/or at least one disperse dye.

The following Examples illustrate the invention in more detail. Temperatures are given in degrees Celsius and parts and percentages are by weight, unless otherwise stated. The relationship between parts by weight to parts by volume is the same as that between the kilo-gramme and the litre.

EXAMPLE 1

A reaction flask, equipped with an agitator, is charged with 50.0 parts by weight of an adduct of 36 ethylene oxide units with castor oil, 30.0 parts by weight of a dodecylamine reacted with 17 ethylene oxide units and quaternised with methyl chloride, 100.0 parts by weight of a polyethylene glycol having a molecular weight of 2000, 50.0 parts by weight of a polypropylene glycol having a molecular weight of 400, and 270.0 parts by weight of water.

The temperature is then raised to about 40° C. and the mixture is stirred at this temperature for 15 minutes until homogeneous and is then cooled while stirring continuously.

This gives 500.0 parts by weight of a printing paste formulation.

EXAMPLE 2

A reaction flask, equipped with an agitator, is charged with 20.0 parts by weight of an adduct of 36 ethylene oxide units with castor oil, 12.0 parts by weight of a dodecylamine reacted with 17 ethylene oxide units and quaternised with methyl chloride, 40.0 parts by weight of a polyethylene glycol having a molecular weight of 2000, 28.0 parts by weight of a polypropylene glycol having a molecular weight of 600, 10.0 parts by weight of a commercially available deaerator (®Lyoprint AIR), 65.0 parts by weight of a 2% aqueous solution of biopolymer, and 25.0 parts by weight of water.

The temperature is then raised to about 40° C. and the mixture is stirred at this temperature for 15 minutes until homogeneous and is then cooled while stirring continuously.

This gives 200.0 parts by weight of a printing paste formulation.

EXAMPLE 3

A reaction flask, equipped with an agitator, is charged with 20.0 parts by weight of an adduct of 36 ethylene oxide units with castor oil, 12.0 parts by weight of a dodecylamine reacted with 17 ethylene oxide units and quatemised with methyl chloride, 40.0 parts by weight of a polyethylene glycol having a molecular weight of 2000, 10.0 parts by weight of a commercially available deaerator (®Lyoprint AIR), 65.0 parts by weight of a 2% aqueous solution of biopolymer, and 53.0 parts by weight of water.

The temperature is then raised to about 40° C. and the mixture is stirred at this temperature for 15 minutes until homogeneous and is then cooled while stirring continuously. This gives 200.0 parts by weight of a printing paste formulation.

EXAMPLE 4

A polyester pile fabric is padded with a liquor comprising 150 g/l of a commercially available alginate thickener (®Lamitex M5 6%), 53 g/l of a commercially available formulation comprising about 20% of a triazine UV absorber, 20 g/l of a commercially available migration inhibitor (®Irgapadol MP), 8 g/l of a commercially available deaerator (®Lyoprint AIR), 4 g/l of monosodium dihydrogenphosphate, 8 g/l of sodium chlorate, 5 g/l of a commercially available dispersant (®Univadin DP), 5 g/l of a commercially available wetting agent (®lnvadin DS), 1.62 g/l of the dye of formula (8)

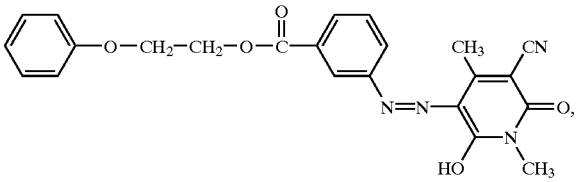

2.37 g/l of the dye of formula (6)

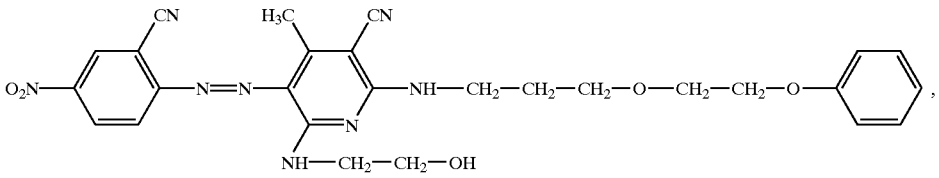

0.8 g/l of the dye of formula (10)

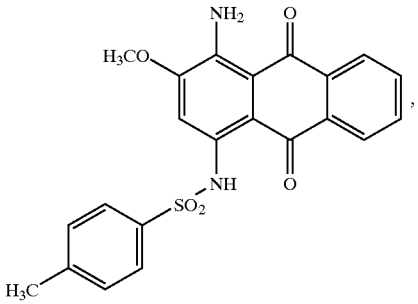

0.61 g/l of the dye of formula (11)

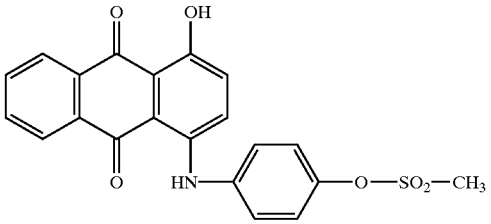

and 9.29 g/l of the dye of formula (12)

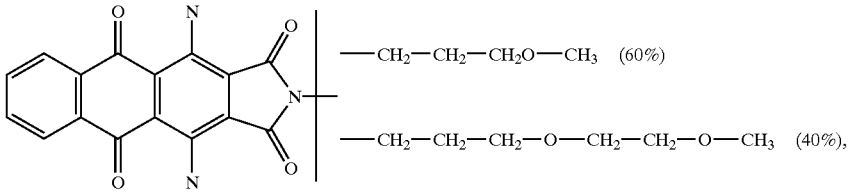

(liquor up-take about 100%).

The dyed polyester fabric is then printed in areas with a printing paste comprising, per 1 kg of printing paste, 20 g of a commercially available dye formulation comprising 25% by weight of a mixture of the dyes of formulae (13)

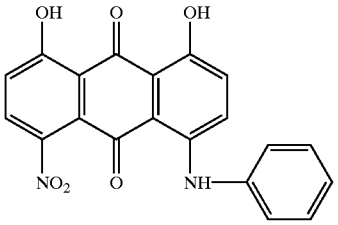

and (14)

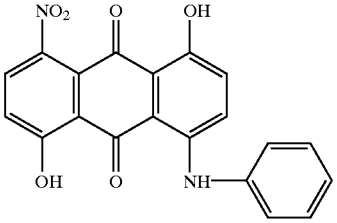

200 g of a commercially available alginate thickener (®Lamitex M5 6%), 200 g of a formulation comprising 10% of a thickener based on starch ether (®Solvitose C5), 2 g of monosodium dihydrogenphosphate, 4 g of sodium chlorate, 25 g of a commercially available formulation comprising about 20% of a triazine UV absorber, 8 g of a commercially available deaerator (®Lyoprint AIR), and 150 g of a printing paste formulation of Example 1.

The treated polyester fabric is then dried and fixed for 8 minutes at 180° C. with HT-steam. After fixing, the printed polyester fabric is washed off by a conventional process, cleaned reductively and dried.

This gives a two-coloured grey-blue resist print having sharp contours and very good fastness to hot light.

EXAMPLE 5

A polyester pile fabric is printed overall with a printing paste comprising, per 1 kg of printing paste, 256 g of a commercially available 6% alginate thickener, 64 g of a formulation comprising 10% of a thickener based on starch ether, 8 g of a commercially available deaerator based on aliphatic hydrocarbons and alcohols, 4 g of monosodium dihydrogenphosphate, 8 g of sodium chlorate, 53 g of a commercially available formulation comprising about 20% of a triazine UV absorber, 1.62 9 of the dye of formula (8), 2.37 9 of the dye of formula (6), 0.8 g of the dye of formula (10), 0.61 g of the dye of formula (11), and 9.29 g of the dye of formula (12).

The printed polyester fabric is then printed in areas with a printing paste comprising, per 1 kg of printing paste, 30 9 of a commercially available dye formulation comprising 29% by weight of the dye of formula (15)

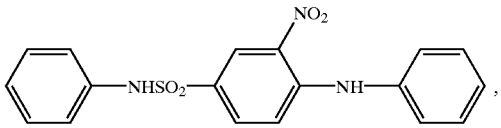

200 g of a commercially available alginate thickener (®Lamitex M5 6%), 200 g of a formulation comprising 10% of a thickener based on starch ether (®Solvitose C5), 2 g of monosodium dihydrogenphosphate, 4 g of sodium chlorate, 25 g of a commercially available formulation comprising about 20% of a tuiazine UV absorber, 8 g of a commercially available deaerator (®Lyoprint AIR), and 200 g of a printing paste formulation of Example 2.

The printed polyester fabric is then dried and fixed for 8 minutes at 180° C. with HT-steam. After fixing, the printed polyester fabric is washed off by a conventional process, cleaned reductively and dried.

This gives a two-coloured grey-yellow resist print having sharp contours and very good fastness to hot light.

EXAMPLE 6

A polyester pile fabric is printed overall with a printing paste comprising, per 1 kg of printing paste, 256 g of a commercially available 6% alginate thickener, 64 g of a formulation comprising 10% of a thickener based on starch ether, 8 g of a commercially available deaerator based on aliphatic hydrocarbons and alcohols, 4 g of monosodium dihydrogenphosphate, 8 g of sodium chlorate, 53 g of a commercially available formulation comprising about 20% of a triazine UV absorber, 1.62 g of the dye of formula (8), 2.37 g of the dye of formula (6), 0.8 g of the dye of formula (10), 0.61 g of the dye of formula (11), and 9.29 g of the dye of formula (12).

The printed polyester fabric is then printed in areas with a printing paste comprising, per 1 kg of printing paste, 200 g of a commercially available alginate thickener (®Lamitex M5 6%), 200 g of a formulation comprising 10% of a thickener based on starch ether (®Solvitose C5), 2 g of monosodium dihydrogenphosphate, 4 g of sodium chlorate, 25 g of a commercially available formulation comprising about 20% of a triazine UV absorber, 8 g of a commercially available deaerator (®Lyoprint AIR), and 300 g of a printing paste formulation of Example 2.

The printed polyester fabric is then dried and fixed for 8 minutes at 180° C. with HT-steam. After fixing, the printed polyester fabric is washed off by a conventional process, cleaned reductively and dried.

This gives a grey-white resist print having sharp contours and very good fastness to hot light.

EXAMPLE 7

A polyester pile fabric is printed overall with a printing paste comprising, per 1 kg of printing paste, 256 g of a commercially available 6% alginate thickener, 64 g of a formulation comprising 10% of a thickener based on starch ether, 8 g of a commercially available deaerator based on aliphatic hydrocarbons and alcohols, 4 g of monosodium dihydrogenphosphate, 8 g of sodium chlorate, 53 g of a commercially available formulation comprising about 20% of a triazine UV absorber, 1.62 g of the dye of formula (8), 2.37 g of the dye of formula (6), 0.8 g of the dye of formula (10), 0.61 g of the dye of formula (11), and 9.29 g of the dye of formula (12).

The printed polyester fabric is then printed in areas with a printing paste comprising, per 1 kg of printing paste, 200 g of a commercially available alginate thickener (®Lamitex M5 6%), 200 g of a formulation comprising 10% of a thickener based on starch ether (®Solvitose C5), 2 g of monosodium phosphate, 4 g of sodium chlorate, 25 g of a commercially available formulation comprising about 20% of a triazine UV absorber, 8 g of a commercially available deaerator (®Lyoprint AIR), 200 g of a printing paste formulation of Example 3, 12 g of the dye of formula (6), and 4 g of the dye of formula (10).

The printed polyester fabric is then dried and fixed for 8 minutes at 180° C. with HT-steam. After fixing, the printed polyester fabric is washed off by a conventional process, cleaned reductively and dried.

This gives a two-coloured grey-red resist print having sharp contours and very good fastness to hot light.

What is claimed is:

1. A process for printing hydrophobic fibre materials with disperse dyes, which comprises 1) dyeing or printing the fibre materials overall with a disperse dye, and 2) printing the fibre materials in areas with a printing paste, which comprises as component (A), at least one cationic assistant selected from the group consisting of organic polymer compounds containing quaternized amines; salts of nitrogen-containing organic polymer compounds and amine oxides of formula (9)

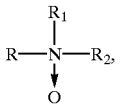

wherein

R is an aliphatic radical containing 8 to 24 carbon atoms, and $R_1$ and $R_2$ are each independently of the other an aliphatic radical which is unsubstituted or substituted by hydroxy, $C_1$–$C_4$ alkoxy, halogen, sulfo or acyl containing 1 to 24 carbon atoms, or a radical —$(CH_2CH_2O)_kW$, wherein k is a number from 2 to 80, and W is $C_1$–$C_4$ alkyl, acyl, phenyl, naphthyl, benzyl or hydrogen, as component (B), at least one polyethylene glycol, as component (C), at least one nonionogenic detergent selected from the group consisting of fatty acid polyglycol esters which are optionally end-capped, fatty acid esters of polyvalent alcohols, naturally occurring and optionally partially saponified neutral fats and those compounds which are obtained by adding 4 to 80 ethylene oxide units and/or propylene oxide units to fatty alcohols, fatty amines, fatty acids or alkylaryls, and as component (D) a polypropylene glycol having a molecular weight in the range from 100 to 2000 and, optionally, as component (E), at least one disperse dye, it being possible for steps 1) and 2) to be carried out in any sequence and for step 2) to be carried out repeatedly without using any dye, or using different dyes, and, if necessary, drying the fibre material thus treated and then fixing the dye on the fibre material by heat treatment.

2. A process according to claim 1, which comprises first dyeing or printing the hydrophobic fibre materials overall with a disperse dye and then printing them in areas once or repeatedly with a printing paste comprising at least one cationic assistant, at least one polyethylene glycol, at least one nonionogenic detergent and, optionally, at least one disperse dye.

3. A process according to claim 1, which comprises first printing the hydrophobic fibre materials once or repeatedly in areas with a printing paste comprising at least one cationic assistant, at least one glycol, at least one nonionogenic detergent and, optionally, at least one disperse dye and then dyeing or printing them overall with a disperse dye.

4. A process according to claim 1, wherein component (B) is a polyethylene glycol having a molecular weight from 200 to 9000.

5. A process according to claim 1, which comprises dyeing the hydrophobic fibre materials in step 1).

6. A process according to claim 1, which comprises printing the hydrophobic fibre materials in step 1).

7. A process according to claim 1, wherein the hydrophobic fibre materials used are polyester fibre materials.

8. A printing paste formulation, which comprises, as component (A), 1 to 50% by weight of at least one cationic assistant selected from the group consisting of organic polymer compounds containing quaternized amines; salts of nitrogen-containing organic polymer compounds and amine oxides of formula (9)

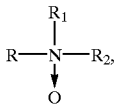

wherein

R is an aliphatic radical containing 8 to 24 carbon atoms, and $R_1$ and $R_2$ are each independently of the other an aliphatic radical which is unsubstituted or substituted by hydroxy, $C_1$–$C_4$ alkoxy, halogen, sulfo or acyl containing 1 to 24 carbon atoms, or a radical —$(CH_2CH_2O)_kW$, wherein k is a number from 2 to 80, and W is $C_1$–$C_4$ alkyl, acyl, phenyl, naphthyl, benzyl or hydrogen, as component (B), 1 to 50% by weight of at least one polyethylene glycol, as component (C), 1 to 50% by weight of at least one nonionogenic detergent selected from the group consisting of fatty acid polyglycol esters which are optionally end-capped, fatty acid esters of polyvalent alcohols, naturally occurring and optionally partially saponified neutral fats and those compounds which are obtained by adding 4 to 80 ethylene oxide units and/or propylene oxide units to fatty alcohols, fatty amines, fatty acids or alkylaryls, and as component (D) a polypropylene glycol having a molecular weight in the range from 100 to 2000.

9. A printing paste formulation according to claim 8, which comprises a polypropylene glycol having a molecular weight from 200 to 600.

10. A printing paste formulation according to claim 8, which comprises as additional component at least one disperse dye.

11. A printing paste formulation according to claim 9, which comprises as additional component at least one disperse dye.

* * * * *